US005781118A

United States Patent [19]

Wise et al.

[11] Patent Number: 5,781,118

[45] Date of Patent: Jul. 14, 1998

[54] SELF-CONTAINED BREATHING APPARATUS HAVING A PERSONAL ALERT SAFETY SYSTEM INTEGRATED THEREWITH

[75] Inventors: Layton A. Wise, Washington, Pa.; Peter A. Frank, London, United Kingdom

[73] Assignee: Mine Safety Appliances Company, Pittsburgh, Pa.

[21] Appl. No.: 565,531

[22] Filed: Nov. 30, 1995

[51] Int. Cl.[6] ..... G08B 23/00

[52] U.S. Cl. ..... 340/632; 340/573; 340/586; 340/626

[58] Field of Search ..... 340/517, 521, 340/539, 540, 586, 573, 626, 628, 632, 691, 693

[56] References Cited

U.S. PATENT DOCUMENTS

| | | | |
|---|---|---|---|
| 4,181,126 | 1/1980 | Hendry | 128/201.21 |
| 4,914,422 | 4/1990 | Rosenfield et al. | 340/573 |
| 5,157,378 | 10/1992 | Stumberg et al. | 340/626 |
| 5,317,305 | 5/1994 | Campman | 340/573 |
| 5,438,320 | 8/1995 | Taylor | 340/573 |
| 5,492,110 | 2/1996 | Lenz | 128/202.22 |
| 5,541,579 | 7/1996 | Kiernan | 340/573 |

FOREIGN PATENT DOCUMENTS

| | | |
|---|---|---|
| 0288903 | 11/1988 | European Pat. Off. . |
| 0324259 | 7/1989 | European Pat. Off. . |
| 0428131 | 5/1991 | European Pat. Off. . |

*Primary Examiner*—Thomas Mullen
*Assistant Examiner*—Edward Lefkowitz
*Attorney, Agent, or Firm*—James G. Uber; Paul D. Bangor, Jr.

[57] ABSTRACT

The present invention provides a self-contained breathing apparatus ("SCBA") having a personal alert safety system ("PASS") fully integrated therewith. The PASS is structurally integrated with the SCBA such that it is protected from damage by both the air cylinder and the frame. The integrated PASS device is not only automatically activated when the SCBA is being used but can still be activated manually if the SCBA is not in service. Additionally, the integrated PASS device utilizes a unique electrical/mechanical connection assembly between its various parts which greatly increases its ruggedness and durability.

20 Claims, 7 Drawing Sheets

SELF-CONTAINED BREATHING APPARATUS HAVING A PERSONAL ALERT SAFETY SYSTEM INTEGRATED THEREWITH

FIELD OF THE INVENTION

Generally, the present invention relates to a Personal Alert Safety System (PASS) that is integrated into and forms part of a self-contained breathing apparatus ("SCBA"). Preferably the PASS device of the present invention includes a motion sensor which causes audible and visual alarms to be activated if movement by the person using the SCBA ceases for a predetermined period of time. More particularly, the present invention provides a lightweight, durable and reliable combined PASS/SCBA wherein the PASS device is formed integral with and is protected by the SCBA.

BACKGROUND OF THE INVENTION

There are various occupations wherein a worker is required to use an SCBA. In some hazardous occupations, such as firefighting, the safety of that worker could be more fully protected if he also used a PASS device having audible and visual alarms which were activated if the motion of the worker ceased for a predetermined period of time. The purpose of these PASS devices is to notify potential rescuers that the firefighter is in trouble and enable them to locate him since he may have lost consciousness in a smoky building. A common problem with many stand-alone PASS devices, however, is that the firefighter frequently fails to don or activate them because of false alarms. Accordingly, it would be desirable if the PASS device was part of the SCBA and was automatically activated when the SCBA was in use.

Attempts have been made to combine a stand-alone PASS device and an SCBA. U.S. Pat. No. 5,157,378 of Stumberg, et al., discloses a stand-alone monitoring and alarm system for use with an SCBA. It has a separate external case containing a motion sensor, a pressure transducer and a temperature sensor to provide audible alarms if the pressure in the SCBA decreases below a certain value, if the temperature exceeds a certain value, or if motion ceases for a predetermined period of time. Similarly, U.S. Pat. No. 5,438,320 mentions that the motion sensor described therein may be coupled directly to an SCBA such that the sensor is activated only when the mask is worn by the firefighter.

There are many shortcomings associated with such devices; however, since the PASS device is not fully integrated with the SCBA. For example, such devices do not provide a combined PASS/SCBA wherein the PASS device is structurally integrated into the SCBA such that it is thoroughly protected from damage if the SCBA is dropped or bumped during use. Moreover, such known devices do not provide a combined PASS/SCBA which can be automatically activated when the SCBA is in use while still being able to be manually activated and reset by the user. It would be desirable therefore to have an integrated PASS device which overcomes these shortcomings because the PASS device is specifically designed to form an integral part of the SCBA.

SUMMARY OF THE INVENTION

Generally, the present invention provides a PASS device which has been fully integrated with an SCBA. The SCBA has a frame which is typically worn on a firefighter's back. The frame is designed to hold an air supply cylinder which is coupled by an air flow system to a facepiece worn by the firefighter. The integrated PASS device itself comprises a main assembly including a motion sensor, which is located within the frame of the SCBA in such a way as to be protected by the air cylinder. It also includes a remote control assembly, preferably located on a shoulder strap of the frame, which is connected to the main assembly by a connection assembly containing both an electrical connection and a mechanical connection. Finally, there is a pressure switch assembly connected between the air flow system and the main assembly for automatically activating the integrated PASS device when a valve on the air supply cylinder is opened.

The SCBA of the present invention is generally shown and described in MSA Data Sheet Nos. 01-00-11 and 01-02-11 for the Custom 4500® and Ultralite® Air Masks manufactured by Mine Safety Appliances Company ("MSA"), Pittsburgh, Pa. The disclosure contained in these Date Sheets is incorporated herein by reference. Similarly, the PASS device of the present invention incorporates many of the features and elements, such as the motion sensor and audible alarm contained in the FireFly® II Personal Alert Safety System shown and described in MSA Data Sheet No. 01-00-22. The disclosure contained in this Data Sheet is incorporated herein by reference. This motion sensor utilizes a flexible, printed circuit board and a noncorrosive, electrically conductive ball bearing to detect movement and sound an alarm when no movement is detected for a predetermined period.

The integrated PASS device of the present invention meets all the requirements of NFPA 1982 (1993 edition) including the proposed revision allowing for integrated PASS devices. Other details, objects and advantages of the present invention will become apparent as the following description of the presently-preferred embodiments and presently-preferred methods of practicing the invention proceeds.

BRIEF DESCRIPTION OF THE DRAWINGS

In the accompanying drawings, the preferred embodiments of the invention and preferred methods of practicing the invention are illustrated in which.

TABLE 1

| Part No. | Description |
|---|---|
| R1 | 22K 1% |
| R2 | 120K 1% |
| R3 | 910K 1% |
| R4 | 150R 1% |
| R5 | 22K 1% |
| R6 | 47R 5% |
| R7 | 10M 5% |
| R8 | 10M 5% |
| R9 | 10M 5% |
| R10 | 100K 1% |
| R11 | 910K 1% 1/8 Watt |
| R12 | 100K 1% |
| R13 | 1K0 5% |
| R14 | N/A |
| R15 | 100K 1% |
| R16 | 200K 1% |
| R17 | 47R |
| R18 | 100K 5% |
| R19 | 10K 5% |
| R20 | 10K 5% |
| R21 | 470K 5% |
| Link | 0 Ohm R |
| R22 | 100K 1% 1/8 Watt |
| IC1 | HT1050 5 V Reg. |
| IC2 | PIC16C71 |
| IC3 | HT7039 Reg. |
| C1 | 10uF Tant 10 V 2.5 mm |
| C2 | 10uF Tant 10 V 5 mm |
| C3 | 1NO 10 V 5 mm |
| C4 | 1NO 10 V 5 mm |
| C5 | 1NO 10 V 5 mm |
| SW1 | Panic Button |
| SW2 | Reset Switch |
| SW3 | Pressure Switch |
| LED1-7 | GAAS |
| Res | CST4.00MGW |
| Q1 | ZTX600B |
| Q2 | BC184L |
| Q3 | BC214 |
| D1 | UF4004 |
| L1 | LHL10 472 |

Figure 9:
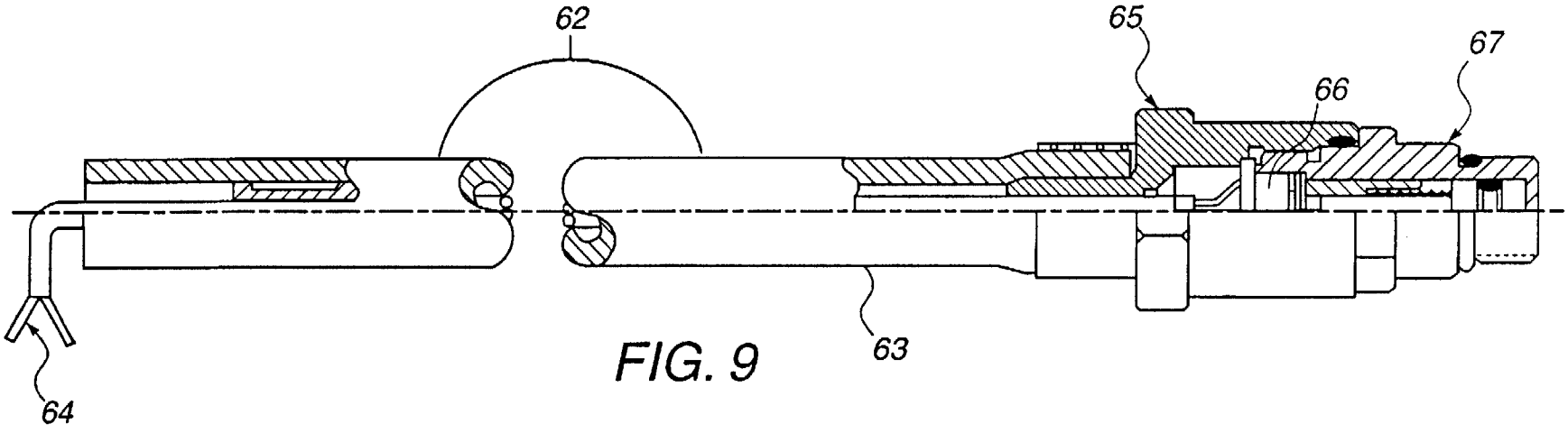

FIG. 9 is a partial cross-sectional view of the pressure switch assembly and connector of the integrated PASS device of the present invention.

Figure 10:
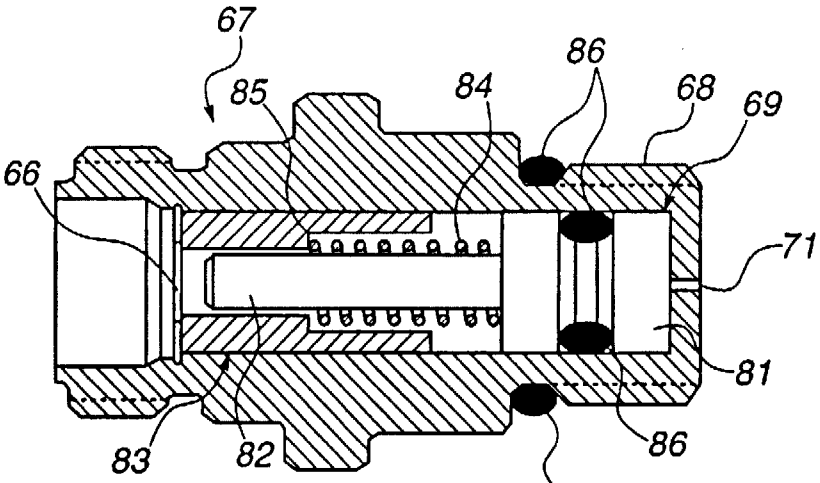

FIG. 10 is a cross-sectional view of the pressure switch assembly of the integrated PASS device of the present invention.

DETAILED DESCRIPTION OF THE PREFERRED EMBODIMENT

The present invention is hereinafter described with respect to the presently-preferred physical embodiments. It will be apparent to those of ordinary skill in the art that various modifications and improvements may be made without departing from the scope and spirit of the present invention. Accordingly, the invention is not limited by the specific embodiments illustrated and described herein, but only by the scope of the appended claims, including all equivalents thereof.

Figure 1:
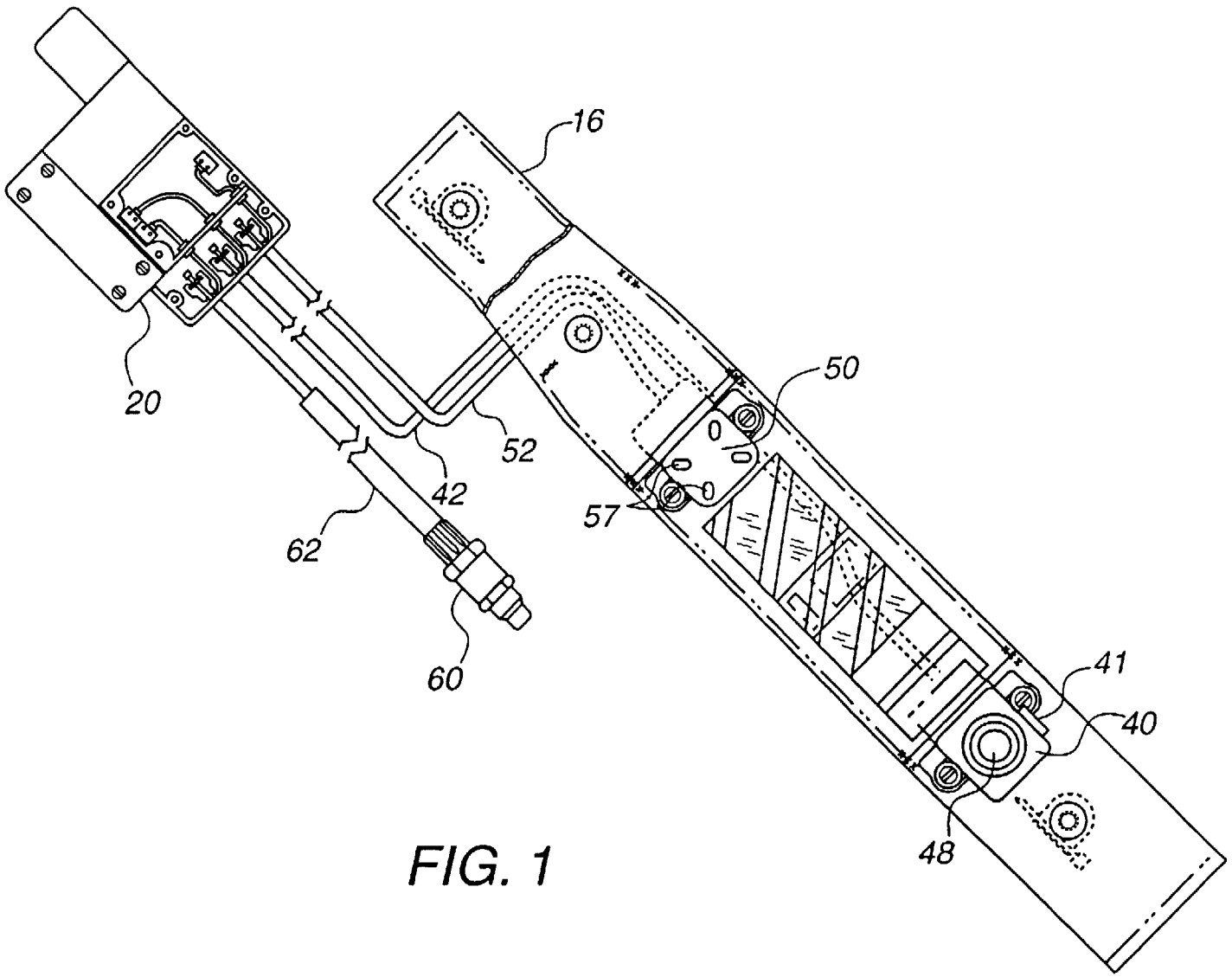
FIG. 1 shows an embodiment of the integrated PASS device of the present invention apart from the SCBA into which it is designed to be incorporated.
Figure 2:
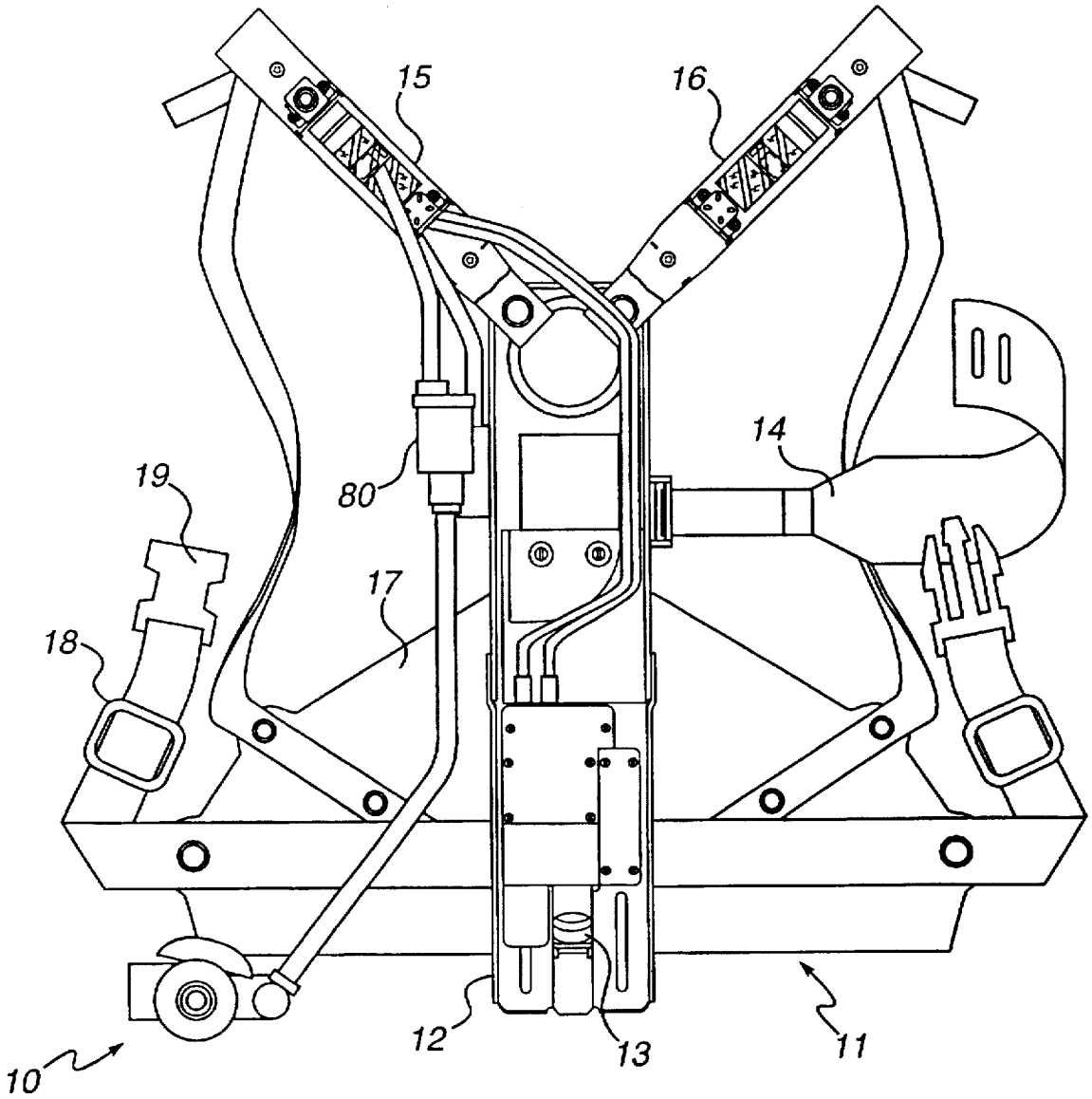
FIG. 2 is a front perspective view of an SCBA (less the air cylinder) with the integrated PASS device of the present invention incorporated therein.
Figure 3:
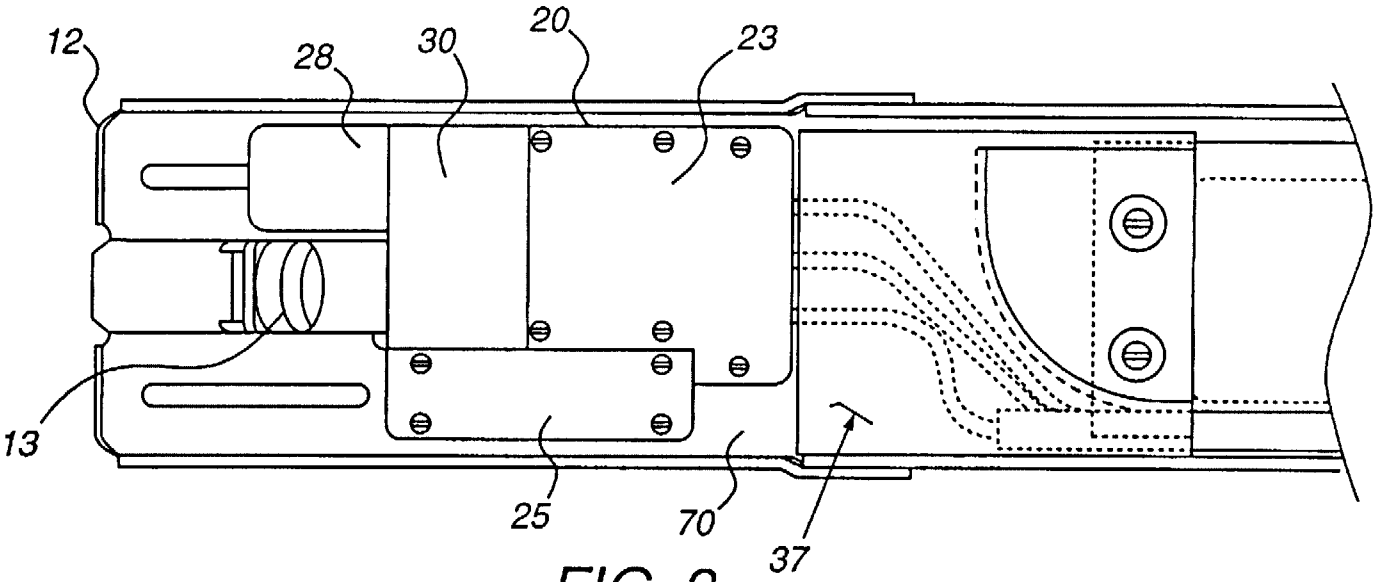
FIG. 3 is a partial top plan view of the main assembly of the integrated PASS device of the present invention disposed within the backplate of an SCBA.
Figure 4:
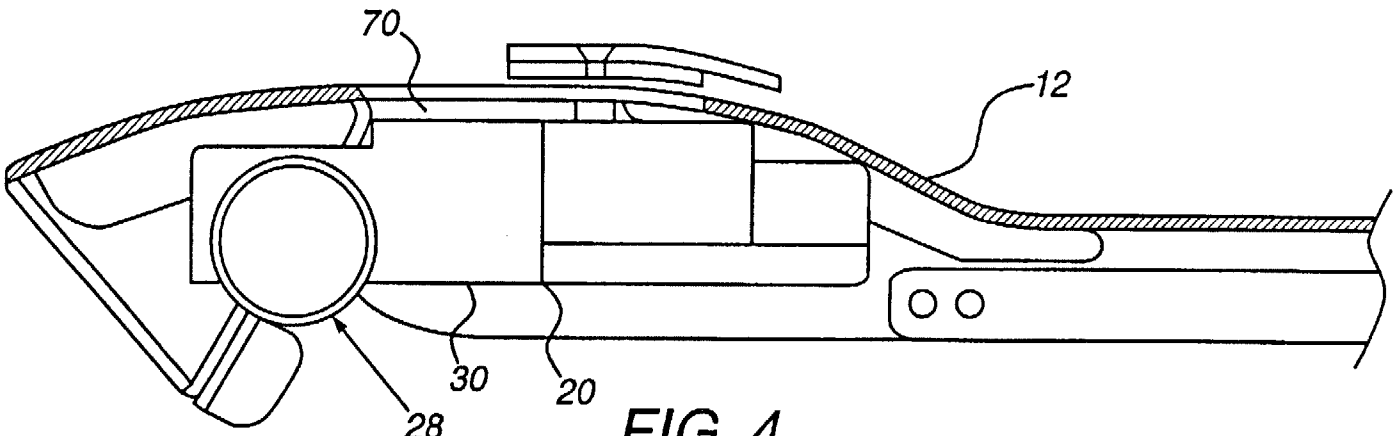
FIG. 4 is a partial side view of the main assembly of the integrated PASS device of the present invention disposed within the backplate of an SCBA.

A preferred embodiment of the integrated PASS device 10 of the present invention is shown in FIG. 1 wherein a main assembly 20 is connected to a remote control assembly 40, an alarm light assembly 50, and a pressure switch assembly 60. As shown in FIG. 2, each of the main assembly 20, the remote control assembly 40, the alarm light assembly 50 and the pressure switch assembly 60 are structurally integrated with the components of an SCBA 11. The SCBA 11 preferably comprises a frame having a backplate 12, a cylinder stop 13, a cylinder retaining band 14, left and right shoulder straps 15 and 16, respectively, a triangular back pad 17 and a waist strap 18 with buckle 19. As shown in FIGS. 3–4, the backplate 12 is ergonomically formed and includes a recess or cavity 70 within which the main assembly 20 is designed to fit. An air cylinder (not shown) is mounted to the backplate 12 using the cylinder stop 13 and the cylinder retaining band 14 such that the main assembly 20 of the integrated PASS 10 is protected by the backplate 12 and the air cylinder. This particular configuration wherein the main assembly 20 is disposed within the backplate 12 and beneath the air cylinder provides for the protection of the integrated PASS 10 from the harsh environment and rough handling which the SCBA typically must endure during normal use.

The main assembly 20 preferably includes a motion sensor and electronic control circuitry, both of which are located in sealed compartment 30. The motion sensor detects movement by the user of the SCBA and is the same as the kind used in the Firefly II PASS Alarm. This motion sensor is also shown and described in U.S. Pat. No. 4,688,025, the disclosure of which is incorporated herein by reference. The main assembly 20 also includes an audible alarm 28, preferably of the piezo electric type, like the one used in the FireFly II PASS Alarm.

In order to fully integrate a PASS device with an SCBA, the combined unit including the electrical and mechanical connections between the various components of the integrated PASS 10 are required to meet the stringent specifications contained in NFPA 1982 (1993 edition) with respect to flame and heat resistance, water resistance, strength, flexibility, size and weight. The connection assemblies 42, 52 and 62 of the integrated PASS 10 of the present invention therefore employ a unique construction which allows such assemblies to meet the required specifications.

Figure 5:
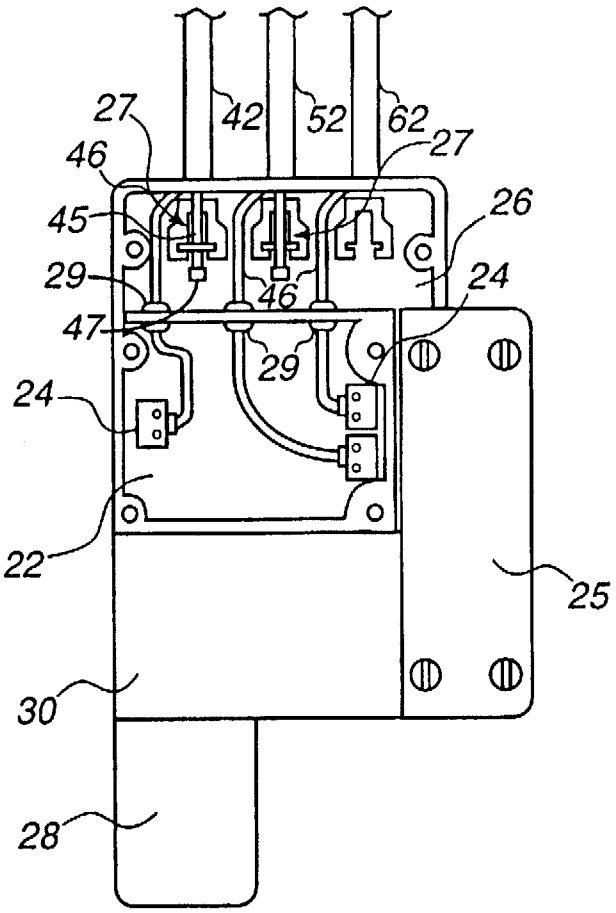
FIG. 5 is a top plan view of the main assembly of the integrated PASS device of the present invention with the connector cover removed to show the electrical/mechanical connections therein.
Figure 6:
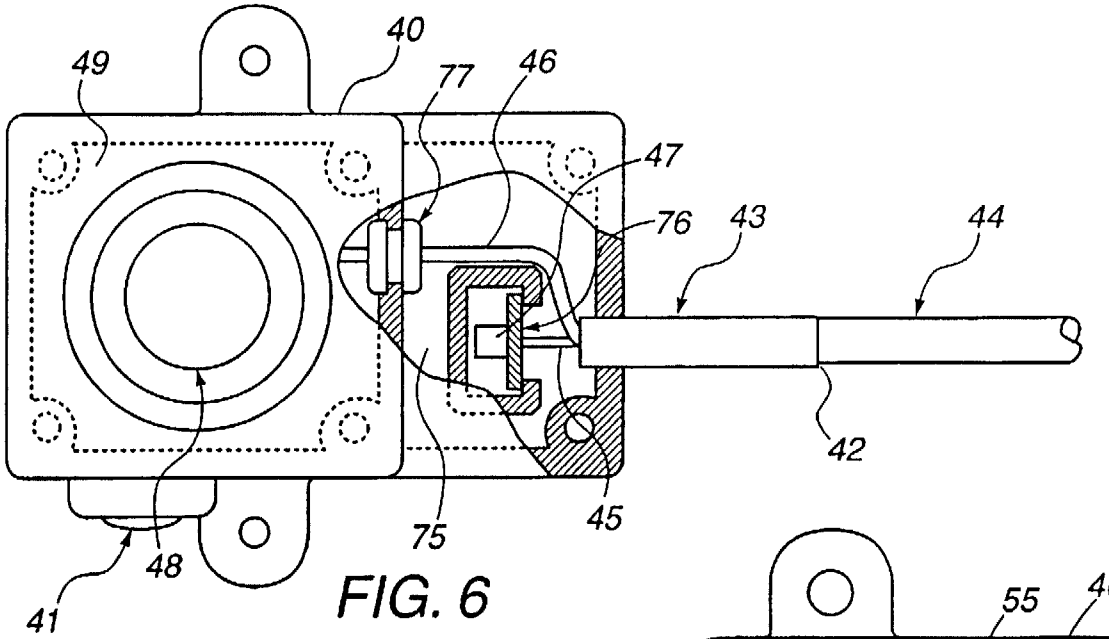
FIG. 6 is a partially cut-away top plan view of the remote control assembly of the integrated PASS device of the present invention.
Figure 7:
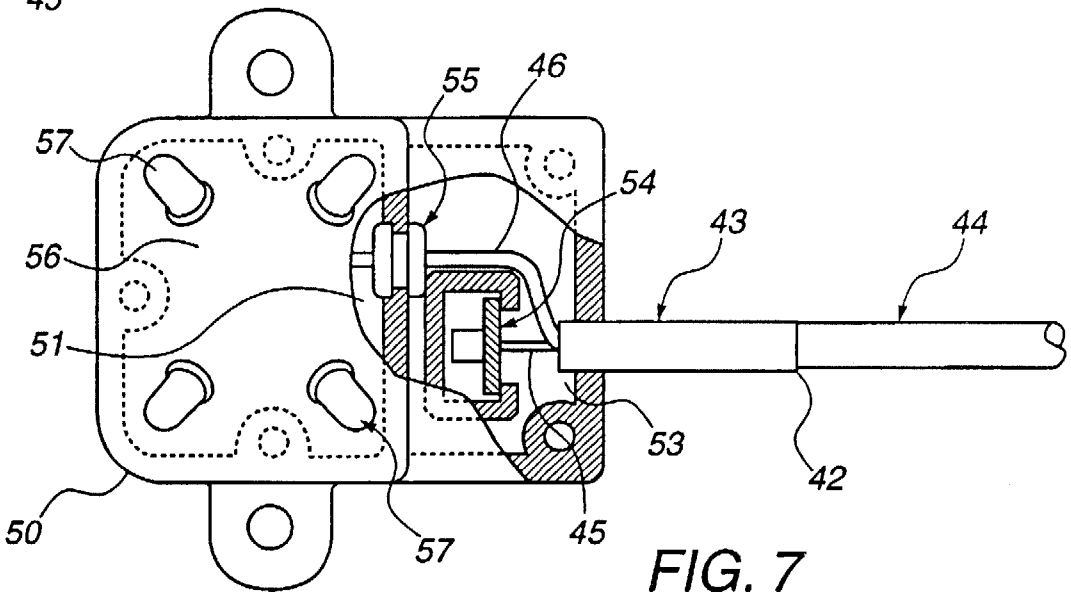
FIG. 7 is a partially cut-away top plan view of the alarm light assembly of the integrated PASS device of the present invention.

As more clearly shown in FIG. 5, the main assembly 20 comprises a housing having various other compartments including a watertight terminal chamber 22 which contains terminal connection blocks 24 for electrically connecting the remote components of the integrated PASS device 10 with the electronic control circuitry contained within the main assembly 20. Watertight terminal chamber 22 is adjacent to and separated from lanyard retaining chamber 26 by water seal grommets 29. As shown in FIGS. 6 and 7, the connection assemblies 42 and 52 for the remote control assembly 40 and the alarm light assembly 50, respectively, each preferably comprise heat shrink tubing 43, a fiberglass sheath 44, a steel strain relief cable 45 with lanyards 47 and an electrical wire 46. In making the electrical and mechanical connection between the connection assemblies 42 and 52 and the main assembly 20, the lanyards 47 of strain relief cables 45 are seated in lanyard retainers 27 within the lanyard retaining chamber 26 as shown in FIG. 5. Electrical wires 46 are inserted through the water seal grommets 29 disposed in apertures in the wall between the watertight terminal chamber 22 and the lanyard retaining chamber 26. As shown in FIG. 3, a cable retaining plate 37 prevents connection assemblies 42 and 52 from being caught or snagged as they run along backplate 12.

The main assembly 20 further comprises a removable connector cover 23 and a removable battery cover 25. The audible alarm 28 is preferably disposed on the lowermost portion of the main control assembly 20 so that it extends below the air cylinder. This particular configuration and location provides maximum protection for the main assembly 20 yet minimizes interference with the components of the SCBA 11 while still enabling the warning signal generated by the audible alarm 28 easily to be heard.

As shown in FIG. 6, the remote control assembly 40 houses the reset button 41 and the panic button 48 which are electrically connected to the main assembly 20 via connection assembly 42. The button chamber 49 of the remote control assembly 40 is made watertight by the same type of electrical/mechanical connection used for terminal chamber 22. More specifically, a separate lanyard retaining chamber 75 is disposed adjacent to the button chamber 49 and houses the lanyard retainer 76 in which the lanyard 47 of connection assembly 42 is received. The electrical wire 46 of connection assembly 42 is inserted through water seal grommet 77 disposed in an aperture in the wall dividing the two chambers to prevent water from entering the button chamber 49. The remote assembly 40 also houses a plurality of LEDs 78 which are used to indicate the various different operating states of the device.

FIG. 7 shows the alarm light assembly 50 which is connected to the main assembly 20 via connection assembly 52. The alarm light chamber 51 of the alarm light assembly 50 is made watertight by the same type of connection used for terminal chamber 22 and the button chamber 49. Here again, a separate lanyard retaining chamber 53, lanyard retainer 54 and the water seal grommet 55 are employed to provide the waterproof electrical connection to alarm light chamber 51. The alarm light assembly 50 further comprises a transparent cover 56 on which a plurality of LEDs 57 are disposed. Preferably, four super bright red LEDs 57 are used to indicate an alarm situation. Although remote control assembly 40 and alarm light assembly 50 have been shown and described as two separate components, there is no reason why they cannot be combined in a single remote control/alarm light assembly.

Figure 8:
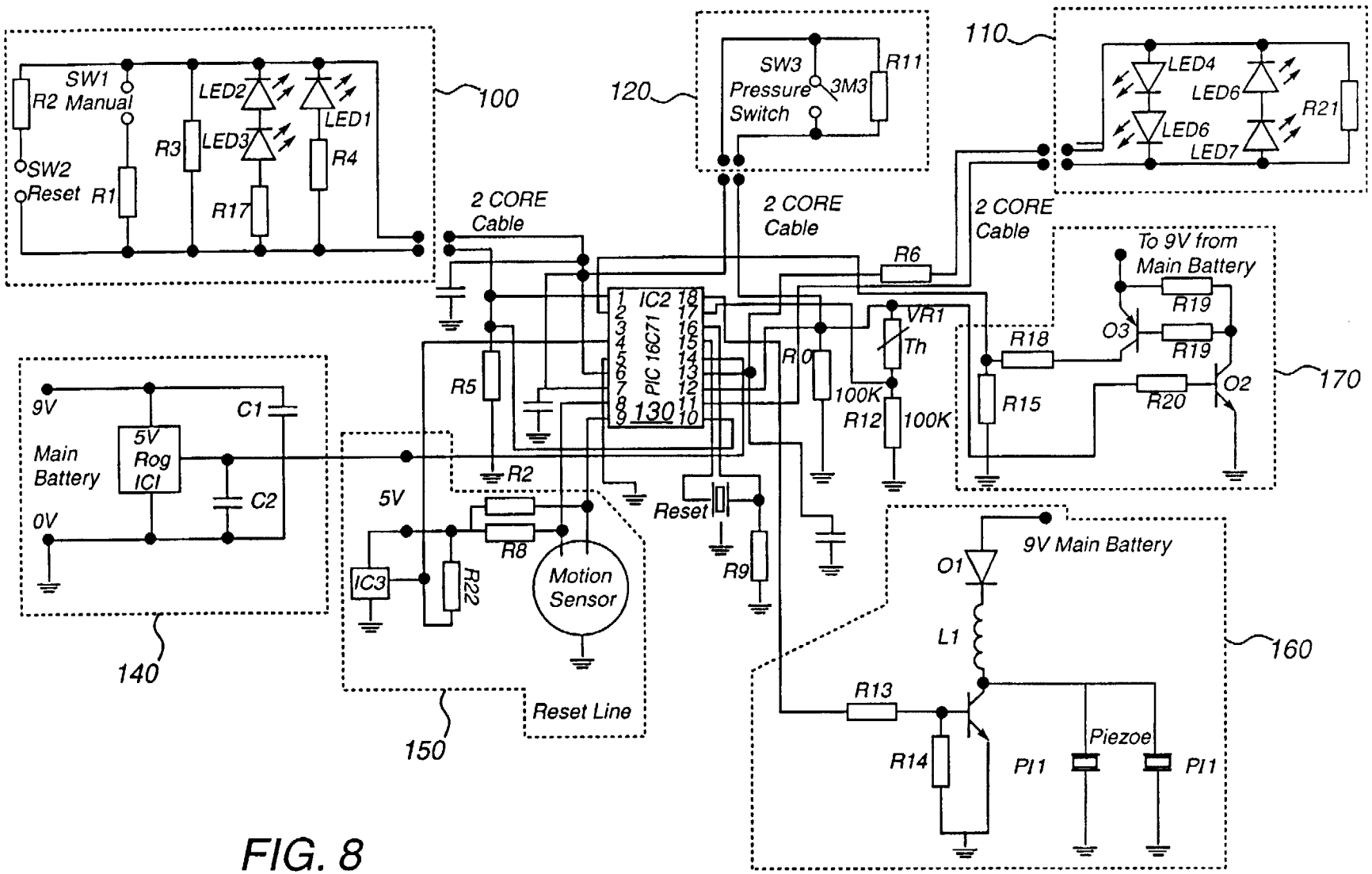
FIG. 8 is a wiring schematic for the integrated PASS device of the present invention.

The electronic circuit for the integrated PASS device is shown in FIG. 8. Preferably it uses a microprocessor-based controller which is electrically connected to the various circuit elements and blocks. Block 100 shows the panic button/reset circuit contained in the remote control assembly 40. Block 110 shows the LED circuit contained in the alarm light assembly 50. Block 120 shows the activation circuit in the pressure switch assembly 50. The remaining control circuitry is housed within the main assembly 20. In addition to the microprocessor 130, this control circuitry comprises a battery circuit 140, a motion detector circuit 150, an audible alarm circuit 160, and a circuit 170. The actual values of the components used in the circuit shown in FIG. 8 are set forth in Table 1 hereinabove.

FIG. 9 shows the pressure switch assembly 50 used in the integrated PASS 10 of the present invention. It has a connection assembly 62 which preferably comprises a high pressure pneumatic hose 63, wire 64 for electrical connection to the control assembly 20 and hose fitting 65. The high pressure pneumatic hose 63 provides the necessary strain relief for the wire 64 disposed therein. If additional strain relief is required, a stainless steel cable may also be used in the switch assembly 60 with lanyard-type connections as described above. A switch contact 66 is disposed on one end of electrical wire 64 and housed within hose fitting 65.

Pressure switch assembly 60 further comprises a pneumatic switch 65 shown in detail in FIG. 10. Pneumatic switch 65 has an inlet connector 68 for connection to the first stage regulator 80 of the SCBA 11. The inlet supply opening 71 of inlet connector 68 communicates with piston chamber 69 housing the piston 81 and the piston rod 82, the latter of which extends through annular sleeve 83. O-rings 86 are employed to prevent air leakage from the first stage regulator 80 and from piston chamber 69. The piston chamber 69 is of such a small volume that is does not interfere with the air being supplied to the user.

The pneumatic switch 67 is activated when the valve on the air cylinder is opened to provide air to the user of the SCBA. Air pressure from the air cylinder enters the piston chamber 69 through inlet supply opening 71 which forces the piston 81 and piston rod 82 to move against spring 84 seated in an annular shoulder 85 of sleeve 83. The air pressure forces the piston rod 82 into contact with switch contact 66 to activate the integrated PASS 10. Thus, the integrated PASS 10 is activated automatically when the user opens the SCBA's air supply cylinder. When the air cylinder is closed (or when the air supply is depleted), the spring 84 forces the piston 81 and piston rod 82 back against the depleting air pressure in chamber 69 until the piston rod 82 no longer contacts switch contact 66. Such opening of the pneumatic switch 67, however, does not deactivate the integrated PASS 10.

Thus, the integrated PASS 10 of the present invention is automatically activated when the air cylinder is activated by opening its valve. The LEDs 57 on the remote control assembly 40 will flash to indicate that the system has been activated. The integrated PASS 10 can also be activated manually, without the air cylinder being opened, by depressing the large panic button 48 thereby immediately putting the system into alarm.

When the PASS 10 is first activated by opening the air cylinder, it will emit an upward sounding tone and the LEDs 57 on the remote control assembly 40 and alarm light assembly 50 will flash one time. In the event that the integrated PASS 10 remains stationary for 30 seconds, plus or minus five seconds, it will emit a pre-alarm warning signal. Movement of the user as detected by the motion sensor or two presses of the reset button 41 will cancel the pre-alarm state. If no movement occurs during the pre-alarm condition (which can last from 7–10 seconds), the full alarm will sound. The full alarm state can be reset by depressing the reset button 41 on the panel control assembly 40 twice in a period of about one second.

The audible alarm 28 and alarm light assembly 50, can be activated manually by depressing the panic button 48 on the remote control assembly 40 at any time. Once activated, the full alarm can only be canceled by depressing the reset button 41 twice in a period of about one second. The integrated PASS device 10 is only turned off by closing the valve on the air cylinder, bleeding pressure from the flow system and then depressing the reset button 41 twice within a period of about one second. The unit will indicate shut down with a special tone signal.

Although the present invention has been described in detail in the foregoing for the purpose of illustration, it is to be understood that such detail is solely for that purpose and that variations can be made therein by those of ordinary skill in the art without departing from the spirit and scope of the invention as defined by the following claims, including all equivalents thereof.

What is claimed is:

1. In a self-contained breathing apparatus ("SCBA") having a facepiece and a frame, an air supply cylinder disposed on the frame, and a flow system coupling the air supply cylinder to the facepiece, the improvement wherein a personal alert safety system ("PASS") device is fully integrated with the SCBA such that the PASS device comprises:

a main assembly, including a motion sensor and electronic control circuitry, disposed within the frame of the SCBA and protected by the air supply cylinder;

a separate remote control assembly accessible and visible to a wearer and connected to the main assembly by a waterproof connection assembly; and a switch assembly connected between the flow system and the main assembly for automatically activating the PASS device when a valve on the air supply cylinder is opened.

2. The SCBA as described in claim 1 wherein the air supply cylinder is adjacent to and covers the main assembly.

3. The SCBA as described in claim 2 wherein the air supply cylinder is adjacent to and covers one side of the main assembly while the frame covers three sides of the main assembly.

4. The SCBA as described in claim 1 wherein the main assembly is located within a recess in the frame.

5. The SCBA as described in claim 1 wherein a portion of the connection assembly is disposed within the frame of the SCBA and protected by the air supply cylinder.

6. The SCBA as described in claim 1 wherein the main assembly further comprises an audible alarm.

7. The SCBA as described in claim 6 wherein the audible alarm is of the piezo electric type.

8. The SCBA as described in claim 1 wherein the separate remote control assembly further comprises a visible alarm.

9. The SCBA as described in claim 8 wherein the visible alarm comprises a plurality of bright LEDs.

10. The SCBA as described in claim 1 wherein the switch assembly comprises a pneumatic pressure switch.

11. In a self-contained breathing apparatus ("SCBA") having a facepiece and a frame, an air supply cylinder disposed on the frame, and a flow system coupling the air supply cylinder to the facepiece, the improvement wherein a personal alert safety system ("PASS") device is structurally integrated with the SCBA such that the PASS device comprises:

a main assembly, including a motion sensor and electronic control circuitry, disposed within a recess in the frame of the SCBA such that it is protected by the air supply cylinder and the frame;

a separate remote control assembly accessible and visible to a wearer and connected to the main assembly by a watertight connection assembly; and a separate pressure switch assembly connected between the flow system and the main assembly for automatically activating the PASS device when a valve on the air supply cylinder is opened, the PASS device remaining activated unless the valve on the air supply cylinder is closed.

12. The SCBA as described in claim 11 wherein the air supply cylinder is adjacent to and covers the main assembly.

13. The SCBA as described in claim 12 wherein the air supply cylinder is adjacent to and covers one side of the main assembly while the frame covers three sides of the main assembly.

14. The SCBA as described in claim 11 wherein the main assembly is located within a cavity in the frame.

15. The SCBA as described in claim 11 wherein a portion of the connection assembly is disposed within the frame of the SCBA and protected by the air supply cylinder.

16. The SCBA as described in claim 11 wherein the main assembly further comprises an audible alarm.

17. The SCBA as described in claim 16 wherein the audible alarm is of the piezo electric type.

18. The SCBA as described in claim 11 wherein the separate remote control assembly further comprises a visible alarm.

19. The SCBA as described in claim 18 wherein the visible alarm comprises a plurality of bright LEDs.

20. The SCBA as described in claim 11 wherein the pressure switch assembly comprises a pneumatic switch.

* * * * *